US008776367B2

(12) United States Patent
Lee et al.

(10) Patent No.: US 8,776,367 B2
(45) Date of Patent: Jul. 15, 2014

(54) METHOD OF MANUFACTURING AN ELECTRET FILM

(75) Inventors: Shih-Yuan Lee, Taipei County (TW); Chih-Kung Lee, Taipei (TW); Wen-Ching Ko, Kaohsiung (TW); Jia-Lun Chen, Tainan (TW); Ing Yih Leu, Taipei (TW); Wen-Hsin Hsiao, Longtan Township, Taoyuan County (TW); Wen-Jong Wu, Taipei (TW)

(73) Assignee: National Taiwan University (TW)

( * ) Notice: Subject to any disclaimer, the term of this patent is extended or adjusted under 35 U.S.C. 154(b) by 697 days.

(21) Appl. No.: 12/422,784

(22) Filed: Apr. 13, 2009

(65) Prior Publication Data

US 2009/0245547 A1 Oct. 1, 2009

Related U.S. Application Data

(63) Continuation-in-part of application No. 12/186,779, filed on Aug. 6, 2008, now Pat. No. 8,111,847.

(60) Provisional application No. 61/035,300, filed on Mar. 10, 2008.

(51) Int. Cl.
*H01B 19/00* (2006.01)

(52) U.S. Cl.
USPC ..... 29/886; 29/896.23

(58) Field of Classification Search
USPC ..... 29/886, 25.35, 592.1, 896.23; 381/59, 381/179, 191
See application file for complete search history.

(56) References Cited

U.S. PATENT DOCUMENTS

| | | | | |
|---|---|---|---|---|
| 5,256,176 | A * | 10/1993 | Matsuura et al. | 55/528 |
| 6,661,563 | B2 * | 12/2003 | Hayashi et al. | 359/296 |
| 2008/0122313 | A1 | 5/2008 | Mabuchi et al. | |
| 2009/0060233 | A1 * | 3/2009 | Liou et al. | 381/191 |

FOREIGN PATENT DOCUMENTS

| | | |
|---|---|---|
| CN | 1993000 | 7/2007 |
| TW | 559844 | 11/2003 |
| TW | I268275 | 12/2006 |
| TW | I294250 | 3/2008 |

OTHER PUBLICATIONS

Office Action dated May 4, 2011 from corresponding application No. CN 200910127378.7.
NOA dated Dec. 18, 2012 from corresponding application No. TW 97151780.
Office Action dated Nov. 4, 2013 from corresponding application No. TW 098122211.

* cited by examiner

*Primary Examiner* — Thiem Phan
(74) *Attorney, Agent, or Firm* — Lowe Hauptman & Ham, LLP

(57) ABSTRACT

A method of making a nonfluoropolymer electret film is provided. The method may include: providing a polymer-containing solution, the polymer-containing solution comprising at least one polymer material, at least one solvent, and at least one surfactant, spreading the polymer-containing solution to provide a wetting polymer film, removing at least a portion of the solvent in the wetting polymer film to provide a polymer film, and conducting a Corona charging to the polymer film to form the electret film.

14 Claims, 2 Drawing Sheets n=5~10

Y=OH, $NH_2$, SH n=5~10

Y=OH, $NH_2$, SH

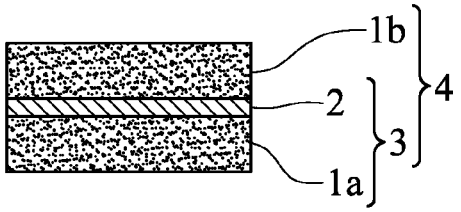
FIG. 4
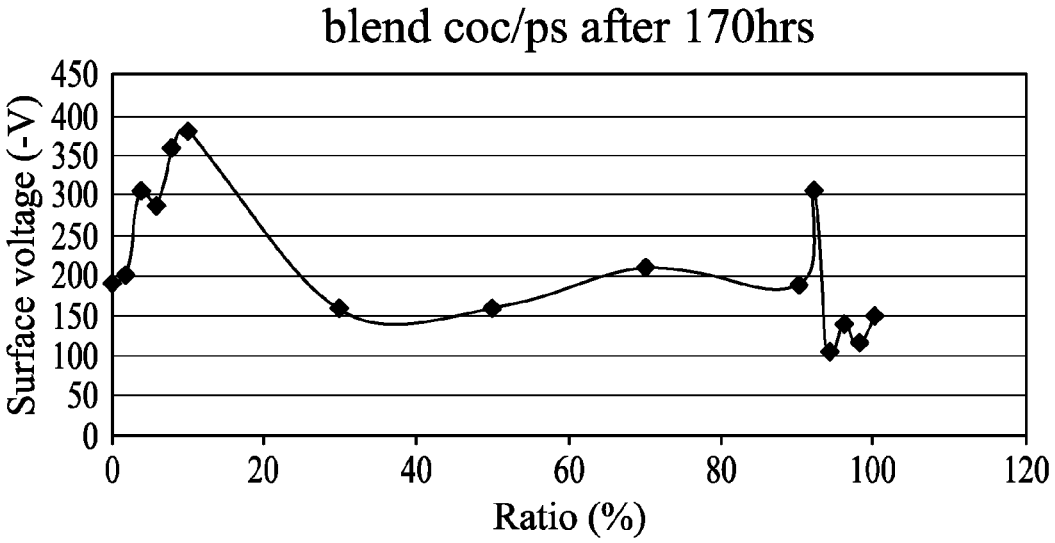
FIG. 5
| Materials (surface voltage) | 150um | 200um | 210um | 220um | 280um |
|---|---|---|---|---|---|
| COC (volt) | | -700 | | -880 | -1394 |
| Blended COC (volt) | -1267 | -1965 | -1996 | | |
FIG. 6

METHOD OF MANUFACTURING AN ELECTRET FILM

RELATED APPLICATION

This application claims the benefit of priority from, and is a continuation-in-part application of, U.S. patent application Ser. No. 12/186,779 filed Aug. 6, 2008 U.S. Pat. No. 8,111,847, entitled "Electret Materials, Electret Speakers, and Methods of Manufacturing the Same," which claims priority from U.S. Provisional Patent Application No. 61/035,300 filed Mar. 10, 2008, entitled "Electret Materials, Electret Speakers, and Methods of Manufacturing the Same."

BACKGROUND

1. Technical Field

This invention relates to electret materials, and more particularly, to an electret speaker and a method of manufacturing the same.

2. Background

An electrostatic speaker operates on the principle of Coulomb's law that two conductors with equal and opposite charge may generate a push-pull force between them. The push-pull electrostatic force may cause vibration of a diaphragm with static charge, and thereby generating sound. An electrostatic speaker may typically include two porous conductive plates or electrode plates and a diaphragm placed between and driven by the conductive plates or electrode plates. The electrodes and the diaphragm are separated by air gaps to provide space for the diaphragm to vibrate. The diaphragm is usually thin and light, and thus making the electrostatic speaker superior to other types of speakers, such as dynamic, moving-coil or piezoelectric speakers, with respect to its transition response, expansion capability in high frequency, smoothness of sound, acoustic fidelity and low distortion. Moreover, the diaphragm must be statically electrical charged, allowing induced static force to drive the diaphragm under the electric field formed by electrode plates when signals are supplied to the electrode plates.

With the simple structure, electrostatic speakers may be manufactured in various sizes to accommodate increasing demand for small and thin electronic devices. However, a conventional electrostatic speaker adopts DC-DC converter to provide the static charge on the diaphragm made by conductor. Considering the size, cost and power consumption of DC-DC converters, electret materials have been developed to replace DC-DC converters. Electret (formed of elektr- from "electricity" and -et from "magnet") is a dielectric material that has a quasi-permanent electric charge or dipole polarization. An electret generates internal and external electric fields, and can be the electrostatic equivalent of a permanent magnet. See, e.g., G. M. Sessler, Topics in Applied Physics, vol. 33, Chapter 1, pg. 1 (1980), and U.S. Pat. No. 4,288,584 (Mishra). The electret charge may include real charge (such as surface and/or space charges) and/or polarization of dipoles. Real charges comprise layers of trapped positive and negative charge carriers.

An exemplary electret speaker is illustrated in FIG. 1, which may include porous electrode plates 6*a* and 6*b*, and a electret diaphragm 4. The electrodes 6*a* and 6*b* may have a number of openings 61*a* and 61*b* on each electrode plate having a porosity of at least 30 percent. The electrode plates 6*a* and 6*b* may be made of metals or plastic materials coated with a conductive film. The openings 61*a* and 61*b* may be provided for allowing sound waves to pass through. The electret diaphragm 4 may include a conductive layer 2 sandwiched between electret layers 1*a* and 1*b*. The electret layers 1*a* and 1*b* may contain either positive charges or negative charges, or may be oriented to have opposite dipole polarization in the normal direction of electret diaphragm 4. The electrode plates 6*a* and 6*b*, and electret diaphragm 4 may be held in place by holding members 5*a* and 5*b*. The holding members 5*a* and 5*b* may be made of insulating materials. The electrode plates 6*a* and 6*b* are separated from the electret diaphragm by insulating elements 51*a*, 51*b*, 52*a* and 52*b*. In operation of an electret speaker, each signal source 7*a* and 7*b* outputs an alternating signal to the electrode plates 6*a* and 6*b* via conductive lines 8*a* and 8*b* respectively. The signals cause a time-varying electric field to develop between the electrode plates 6*a* and 6*b* and the electret layers 1*a* and 1*b*, thus resulting in a electrostatic force between electrode plates 6*a* and 6*b* and electret diaphragm 4. The electrostatic force may cause the electret diaphragm 4 to vibrate to generate sound. The resultant sound waves may pass through holes 61*a* and 61*b*, therefore, the sound waves could be heard outside the electret speaker.

However, for an electret speaker to enhance its acoustic fidelity and low distortion, it requires an electret material with excellent electret properties and also a delicate process to fabricate a thin electret-metal-electret structure. It has previously been known to make electrets from various polymers. Charges are generated in the polymer electrets film by subjecting it to a DC corona treatment. Of the various polymers that have been proposed the fluoropolymers, such as poly (tetrafluoroethylene) (PTFE), and fluorinated ethylene propylene (FEP), have been found to give rise to stable electret properties even at high temperatures and high humility. However, fluoropolymers may be expensive and may require certain processing techniques. Fluoropolymers may possess low friction coefficients on the surface, so that there is no seizure or stick-slip action. Therefore, these fluoropolymers do not adhere well to metals and are not suitable for being fabricated into a electret diaphragm in the electret speaker system. It has also been known previously to make electret from non-fluoropolymers, such as polystyrene (PS), polycarbonate (PC), polyvinyl chloride (PVC), polymethylmethacrylate (PMMA) and cyclic olefin copolymer (COC) These non-fluoropolymers mentioned above may be applied to fabricate as the electret diaphragms much easier than those fluoropolymers in electret speaker application. However, the initially high surface potential of electrets made from these non-fluoropolymers reduces relatively rapidly. This applies especially when the humidity is high. Therefore, there is still a need to make non-fluoropolymer electret whose electret properties are retained for longer period of time.

U.S. Pat. No. 4,654,546 and U.S. Pat. No. 6,852,402 described producing a cellular ferroelectret film made of polypropylene. During corona-charging process, the electric field causes dielectric breakdown inside each polymer cell: the dielectric breakdown deposits equal and opposite electrical charges on opposite interior surfaces of the cell. Each cell in the cellular ferroelectret which has space charges on its walls acts like a dipole. Therefore, the cellular ferroelectret acts like a dipolar electret with a large dipole moment and gets better electret properties than those solid electrets.

In the prior art, voids in cellular ferroelectret are formed by spontaneously open up in polymers that contain tiny foreign particles such as silicates ("sand") when those polymers are highly stretched. Simultaneous or sequential stretching in two perpendicular directions results in films with lens-shaped voids. Those voids are often too flat for efficient charging by means of internal micro-plasma discharges, because the plasma electrons cannot be accelerated sufficiently to ionize the gas molecules. Additional, it may be difficult to control the thickness of a film when a film-stretching technique is used to make a cellular ferroelectret.

BRIEF SUMMARY

Embodiments disclosed herein may provide a method of making an electret film. The method may include: providing a polymer-containing solution, the polymer-containing solution comprising at least one polymer material, at least one solvent, and at least one surfactant; spreading the polymer-containing solution to provide a wetting polymer film; removing at least a portion of the solvent in the wetting polymer film to provide a polymer film; and conducting a Corona charging to the polymer film to form the electret film.

Embodiments disclosed herein may provide a speaker. The speaker may include: audio signal input having a first signal-source terminal and a second signal-source terminal, the audio signal input being configured to receive an audio signal; two electrodes being placed apart from each other; and an electret film comprising at least one electret layer and remotely coupled between the two electrodes. Specifically, the first electrode of the two electrodes may be coupled with the first signal-source terminal, and the second electrode of the two electrodes may be coupled with the second signal-source terminal. The electret film may be configured to interact with the first electrode and the second electrode in response to the audio signal supplied through the first signal-source terminal and the second signal-source terminal. Additionally, the electret film may be configured to vibrate to generate sound. In one embodiment, the electret layer may include a polymer layer having a plurality of holes and being formed from a polymer-containing solution.

It is to be understood that the foregoing general descriptions and the following descriptions are exemplary and explanatory only and are not restrictive of the invention.

BRIEF DESCRIPTION OF THE SEVERAL VIEWS OF THE DRAWINGS

The foregoing summary, as well as the following detailed description of the disclosed embodiments, will be better understood when read in conjunction with the appended, exemplary drawings. It should be understood, however, that the disclosed embodiments are not limited to the precise arrangements and instrumentalities shown.

In the drawings:

FIG. 4 shows a sectional view of portions of an electret speaker consistent with the disclosed embodiments;

FIG. 5 is a chart showing surface voltage of a blend of cyclic olefin copolymer and polystyrene; and FIG. 6 is a table illustrates surface charges of cyclic olefin copolymer and blended cyclic olefin copolymer in different thickness.

DETAILED DESCRIPTION OF THE DISCLOSED EMBODIMENTS

Embodiments disclosed herein may generate holes inside non-fluoropolymer film, thereby improving electret properties in non-fluoropolymer electret film. In some embodiments, the holes may have shapes that are nearly spherical and may contain partial discharges on interior surfaces. An electret speaker may be made with electret diaphragm of a non-fluoropolymer electret film. Embodiments disclosed herein may provide a method of manufacturing a non-fluoropolymer electret film with holes.

Figure 1:
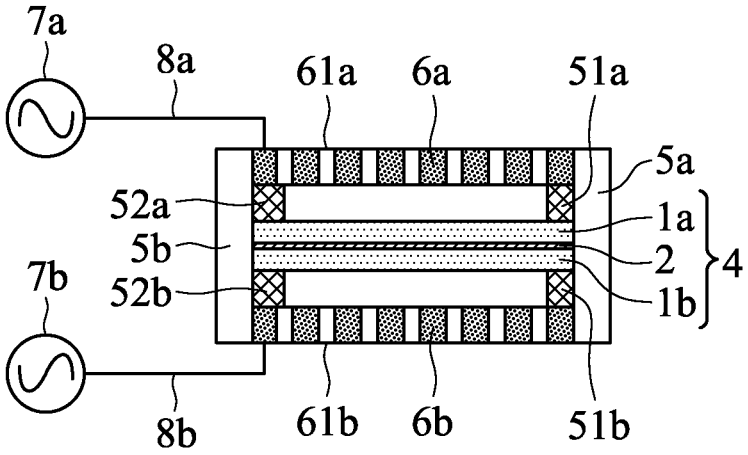
FIG. 1 is a sectional view of an exemplary electret speakers in prior art.
Figure 2:
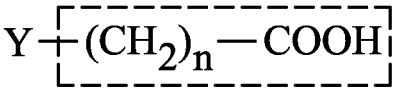
FIG. 2 is a formula of a hydrophobic hydrocarbon.

The disclosed embodiments are related to a non-fluoropolymer electret film that is formed from a polymer-containing solution. The polymer-containing solution may comprise at least one polymer material and at least one surfactant. The polymer material may include one or more of cyclic olefin copolymer (COC), polystyrene (PS), polycarbonate (PC), polymethylmethacrylate (PMA), polyvinyl chloride (PVC)polyimide (PI), polyetherimide (PEI), high density polyethylene (HDPE), and polypropylene (PP). The surfactant may include one or more of: (n+1)-hydroxy-alkanoic acid, (n+1)-amino-alkanoic acid, (n+1)-sulfanyl-alkanoic acid, 2-(n-hydroxy-alkyl)malonic acid, 2-(n-mercapto-alkyl) malonic acid, 2-(n-amino-alkyl_malonic acid, 2,3-bis-(n-hydroxy-alkyloxy)-succinic acid, 2,3-bis-(n-amino-alkyloxy)-succinic acid, (n+1)-triazol-alkanoic acid, 2,3-bis-(n-triazol-alkyloxy)-succinic acid, sodium dodecyl sulfate (SDS), amphoteric surfactants, nonionic surfactants, cationic surfactants, and anionic surfactants. To dissolve the polymer material and surfactant in solution form, solvent such as one or more of acetone, tetrahydrofuran (THF), toluene, xylene, p-xylene, dichloromethane, chloroform, n-methylpyrrolidone (NMP), and dimethylformamide (DMF) may be added in the polymer-containing solution. FIG. 2 shows a formula of a long-chain hydrophobic hydrocarbon having the formula: $Y—(CH_2)_n—COOH$ in which Y is OH, $NH_2$, or SH, and n ranges from 5 to 10. Specific examples of the hydrocarbon include 6-hydroxyhexanoic acid, 7-hydroxyheptanoic acid, 8-hydroxyoctanoic acid, 9-hydroxynonanoic acid, 10-hydroxydecanoic acid, 11-hydroxyundecanoic acid, 6-mercaptohexanoic acid, 7-mercaptoheptanoic acid, 8-mercaptooctanoic acid, 9-mercaptononanoic acid, 10-mercaptodecanoic acid, 11-mercaptoundecanoic acid, 6-aminohexanoic acid, 7-aminoheptanoic acid, 8-aminooctanoic acid, 9-aminononanoic acid, 10-aminodecanoic acid, and 11-aminoundecanoic acid. The hydrocarbon may have a highly polar carboxylic acid ground [—COOH] at one end. At the other end, it may be hydroxyl functional group or amine functional group or thiol functional group. As a result, (n+1)-hydroxy-alkanoic acid or (n+1)-amino-alkanoic acid or (n+1)-sulfanyl-alkanoic acid may be generated. In an embodiment, the blended polymer solution may contain hydroxyl acid compounds such as 8-hydroxyoctanoic acid as the surfactant and cyclic olefin copolymer (COC) as the polymer material. Specifically, the hydroxyl acid compound with a concentration of 1-10000 ppm by weight may be dissolved in THF (tetrahydrofuran) solution to generate solution A1. COC with a concentration of 0.1-15 weight percent may be dissolved in a solvent, such as toluene, xylene or p-xylene, to generate solution B1. In one embodiment, COC may be at least one of TOPAS®COC family or Arton®COC family, including but not limited to grades 8007, 6013, 5013, 5017 and 6017. The solutions A1 and B1 are mixed with a certain ratio so that the solution A1 has about 0.01-30000 ppm by weight to the resultant blended polymer solutions. As an example, 8-hydroxyoctanoic acid may have the structure of $[HO—(CH_2)n-COOH]$, with n being 7.

In another embodiment disclosed herein, the blended polymer solution may contain hydroxyl acid compounds, such as 8-hydroxyoctanoic acid, as the surfactant and at least one of polystyrene (PS), polycarbonate (PC), polyvinyl chloride (PVC) and polymethylmethacrylate (PMMA) as the polymer material. Specifically, the hydroxyl acid compound with 1-10000 ppm may be dissolved in, for example, dichloromethane or chloroform solution to generate solution A2. Polymers, such as polystyrene (PS), polycarbonate (PC), polyvinyl chloride (PVC), or polymethylmethacrylate (PMMA), with 0.1-10 weight percent may be dissolved in a solvent to form solutions B2-1, B2-2, B2-3 and B2-4. In one embodiment, the solvent may be chloroform. The solution A2 may be mixed with B2-1, B2-2, B2-3 or B4 to a certain ratio so that the solution A2 has about 0.01-30000 ppm by weight to the resultant blended polymer solutions.

Figure 3:
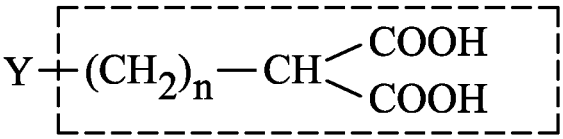
FIG. 3 is a formula of a hydrophobic hydrocarbon.

FIG. 3 shows the formula of a long-chain hydrophobic hydrocarbon having the formula: $Y—(CH_2)_n—CH(COOH)_2$ in which Y is OH, $NH_2$, or SH, and n ranges from 5 to 10. Specific examples of the hydrocarbon include 2-(5-hydroxypentyl)malonic acid, 2-(6 hydroxyhexyl)malonic acid, 2-(7-hydroxyheptyl)malonic acid, 2-(8-hydroxyoctyl)malonic acid, 2-(9-hydroxynonyl)malonic acid, 2-(10-hydroxydecyl) malonic acid, 2-(5-mercaptopentyl)malonic acid, 2-(6-mercaptohexyl)malonic acid, 2-(7-mercaptoheptyl)malonic acid, 2-(8-mercaptooctyl)malonic acid, 2-(9-mercaptononyl)malonic acid, 2-(10-mercaptodecyl)malonic acid, 2-(5-aminopentyl)malonic acid, 2-(6-aminohexyl)malonic acid, 2-(7-aminoheptyl)malonic acid, 2-(8-aminooctyl)malonic acid, 2-(9-aminononyl)malonic acid, and 2-(10-aminodecyl)malonic acid. The hydrocarbon has two highly polar carboxylic acids [—COOH] at one end. At the other end, it may have hydroxyl functional group or amine functional group or thiol functional group. As a result, 2-(n-hydroxy-alkyl)malonic acid, 2-(n-mercapto-alkyl)malonic acid, or 2-(n-amino-alkyl) malonic acid may be used. In still another embodiment, the blended polymer solution may contain at least one of 2,3-bis-(n-hydroxy-alkyloxy)-succinic acid and 2,3-bis-(n-amino-alkyloxy)-succinic acid. Either of them with 1-10,000 ppm by weight may be dissolved in a solvent to generate solution A3. In one embodiment, the solvent may be tetrahydrofuran, dichloromethane or chloroform. The solution A3 may be mixed with B1, B2-2, B2-3 or B4 to a certain ratio so that the solution A3 has about 0.01-30000 ppm by weight to provide the resultant blended polymer solution.

In one embodiment, the method of making an electret film using a polymer-containing solution may include several steps. Topas® COC 8007 pellets with about 15 wt % (weight percentage) may be dissolved in a solution of Toluene (such as Toluene, Acros, 99%, with a density of about 0.866 g/mL). The solution may be heated to 80° C. and/or mixed to provide solution A. 8-hydroxyoctanoic acid may be dissolved in Tetrahydrofuran (THF) (such as, Tetrahydrofuran (THF), Aldrich, about 99%, with a density of about 0.899 g/mL) with about 0.01-1 wt % under room temperature (about 25° C.) to provide solution B. Solutions A and B may be combined with 95 to 5 weight ratio. In one embodiment, the mixed solutions can be placed in a mixer for about 10 minutes and an ultrasonic device (such as an ultrasonic mixer or cleaner) for about 5 minutes, resulting in solution C.

Solution C may be spin-coated over a copper-foil substrate, such as using a spin coating device operated at about 1,500 revolutions-per-minute (rpm), such as for about 2 times and about 20 seconds each time, to provide a wetting polymer film. The wetting polymer film may be dried under room temperature or a temperature of 20~25° C. for about 30 minutes. It may also be heated in a vacuum oven (about 0.1 Torr) or an oven having a pressure lower than the ambient pressure for about 8 hours. Most or all of the solvent or water in the film should evaporate, resulting in a polymer film having holes having an average size of about 1 micrometer in one embodiment. In some embodiments, the polymer film with holes may have a thickness of 8±μm.

After the formation of the film, the film may subject to a charging process, such as using a discharging device with a needle plate biased at minus 20 kV, to form an electret film in one embodiment. The distance between the discharging plate or needles and the film may be about 4 centimeters. In one embodiment, the process may performed under a temperature of about 20-25° with a relative humidity (RH) of about 45-50%. The temperature, distance, relative humidity, and discharging bias may be adjusted based on various factors, such as the values of those parameters, other external conditions, film material, thickness, or properties, and desired electret properties.

In another embodiment, the method of making an electret film using a polymer-containing, solution may include several steps. Topas®COC 8007 pellets with about 15 wt % (weight percentage) may be dissolved in a solution of Toluene (such as Toluene, Acros, 99%, with a density of about 0.866 g/mL). The solution may be heated to 80° C. and/or mixed to provide solution A. 2-(6-mercaptohexyl)malonic acid may be dissolved in Tetrahydrofuran (THF) (such as, Tetrahydrofuran (THF), Aldrich, about 99%, with a density of about 0.899 g/mL) with about 1 wt % under room temperature (about 25° C.) to provide solution B. Solutions A and B may be combined with about 90 to 10 in weight ratio. In one embodiment, the mixed solutions can be placed in a mixer for about 10 minutes and an ultrasonic device (such as an ultrasonic mixer or cleaner) for about 5 minutes, resulting in solution C.

Solution C may be spin-coated over a copper-foil substrate, such as using a spin coating device operated at about 1500 rpm, such as for about 2 times and about 20 seconds each time, to provide a wetting polymer film. The wetting polymer film may be dried under room temperature or a temperature of 20~25° C. for about 30 minutes. It may also be heated in a vacuum oven (about 0.1 Torr) or an oven having a pressure lower than the ambient pressure for about 8 hours. Most or all of the solvent or water in the film should evaporate, resulting in a polymer film having holes having an average size of about 100 nanometers in one embodiment. In some embodiments, the polymer film with holes may have a thickness of 8±μm.

After the formation of the film, the film may subject to a charging process, such as using a discharging device with a needle plate biased at minus 20 kV, to form an electret film in one embodiment. The distance between the discharging plate or needles and the film may be about 4 centimeters. In one embodiment, the process may performed under a temperature of about 20~25° C. with a relative humidity (RH) of about 45-50%. The temperature, distance, relative humidity, and discharging bias may be adjusted based on various factors, such as the values of those parameters, other external conditions, film material, thickness, or properties, and desired electret properties.

In still another embodiment, the method of making an electret film using a polymer-containing solution may include several steps. Topas®COC 8007 pellets with about 15 wt % (weight percentage) may be dissolved in a solution of Toluene (such as Toluene, Acros, 99%, with a density of about 0.866 g/mL). The solution may be heated to 80° C. and/or mixed to provide solution A. 2-(10-Hydroxydecyl)malonic acid may be dissolved in Tetrahydrofuran (THF) (such as, Tetrahydrofuran (THF), Aldrich, about 99%, with a density of about 0.899 g/mL) with about 1 wt % under room temperature (about 25° C.) to provide solution B. Solutions A and B may be combined with about 95 to 5 in weight ratio. In one embodiment, the mixed solutions can be placed in a mixer for about 10 minutes and an ultrasonic device (such as an ultrasonic mixer or cleaner) for about 5 minutes, resulting in solution C.

Solution C may be spin-coated over a copper-foil substrate, such as using a spin coating device operated at about 1500 rpm, such as for about 2 times and about 20 seconds each time, to provide a wetting polymer film. The wetting polymer film may be dried under room temperature or a temperature of 20~25° C. for about 30 minutes. It may also be heated in a vacuum oven (about 0.1 Torr) or an oven having a pressure lower than the ambient pressure for about 8 hours. Most or all of the solvent or water in the film should evaporate, resulting in a polymer film having holes having an average size of about 400 nanometers in one embodiment. In some embodiments, the polymer film with holes may have a thickness of 8±μm.

After the formation of the film, the film may subject to a charging process, such as using a discharging device with a needle plate biased at minus 20 kV, to form an electret film in one embodiment. The distance between the discharging plate or needles and the film may be about 4 centimeters. In one embodiment, the process may performed under a temperature of about 20-25° C. with a relative humidity (RH) of about 45-50% The temperature, distance, relative humidity, and discharging bias may be adjusted based on various factors, such as the values of those parameters, other external conditions, film material, thickness, or properties, and desired electret properties.

In another embodiment, the blended polymer solution may contain at least two different polymer solutions. COC with a concentration of 1-15 by weight percent may be dissolved a solvent to form solution A4. A different type of polymer materials, such as polystyrene (PS) may be dissolved in a solvent to form solution B4. In one embodiment, the solvent may be at least one of toluene, xylene and p-xylene. The solutions A4 and B4 are mixed with an appropriate ratio to generate the resultant blended solutions. After a dry process and a corona charge process, it is observed that the surface potential of the blended polymers increases in comparison with the surface potential of the original polymers. FIG. 5 is a chart showing surface voltage of a blend of cyclic olefin copolymer and polystyrene. As shown in FIG. 5, the surface voltage of the blended COC/PS in a 85/15 or 15/85 ratio (more precisely, about a 90/10 or 10/90 ratio) increases at least 190%. It is observed that the blended polymer provides crystallization interfaces and thus improving the charge storage capability and stability.

In some embodiments, at least one of polycarbonate (PC), polymethylmethacrylate (PMMA) and polyvinyl chloride (PVC) may be dissolved in a solvent, such as toluene, xylene and p-xylene. In addition, at least one of polyethylene (PE) and polypropylene (PP) may be dissolved in p-xylene at a temperature of about 120° C. These solutions may be mixed with an appropriate ratio to generate the resultant blended solution. Similar to the embodiment illustrated earlier, in another embodiment, polyimide (PI) and polyetherimide (PEI) may be dissolved in a solvent such as N-Methylpyrrolidone (NMP) or Dimethylformamide (DMF). These solutions may be mixed with an appropriate ratio to generate the resultant blended solution.

In another embodiment consistent with the present invention, the polymer solutions in the aforementioned embodiments may comprise or further comprise highly polar carboxylic acids [—COOH] to improve the electret property. In one embodiment, the polymer solutions illustrated earlier may be spread over an non-woven material, such as polyethylene (PE), polypropylene (PP), poly(ethylene terephthalate) (PET), nylon, blends of polypropylene (PP) and nylon or blends of polypropylene (PP) and poly(ethylene terephthalate) (PET). In some embodiments, the polymer solutions may further include nanometer-scale particles or micrometer scale fibers. In one embodiment, the particles or fibers may be at least one of poly(ethylene terephthalate) (PET), poly tetrafluoroethylene (PTFE), fluorinated ethylene propylene (FEP), silicon dioxide, aluminum oxide, titanium dioxide, and high density polyethylene (HDPE).

To form an electret layer, the blended solution as mentioned above may be spread over a surface or an underlying layer by at least one of spin coating, screen printing, spraying coating, sputtering, evaporating, and scraping techniques to form a wetting polymer film. The wetting polymer film is then dried, such as under a controlled environment or a controlled temperature. In one embodiment, an environment with a temperature of 20 to 25° C. may be provided, but the environmental conditions may be varied to control the drying process, such as using an oven as illustrated above. The drying process allows the removal of at least a portion of the solvent in the wetting polymer film to provide a polymer film. During the drying process, the polymers and highly-polar compounds may form a self-assembling structure which provides holes in the range of nanometer to micrometer scale. In some embodiments, the polymer film formed as a result of the process may have a plurality of holes with sizes between about several nanometers, such as 10 nanometers, to about 10 micrometer. Such a structure may increase electret area of the blended polymers.

In some embodiments, Polymer/surfactant micelles may be formed in the polymer-containing solution when surfactant concentration is higher than the critical micelle concentration (CMC). The resulting holes, which may maintain dielectric breakdown during a corona-charging process, may enhance electret properties of the non-fluoropolymer electret film. In some embodiments, the polymer material and the surfactant may have a weight ratio of about 0.01 to $10^5$ ppm.

In addition, the electret property of the polymer layer or electric charges may be introduced into the polymer layer may be improved by charging process, such as a corona charging process. A non-fluoropolymer electret film is then formed through the process illustrated. In one embodiment, the electret property of COC may be improved up to 140% as shown in FIG. 6. An electret layer such as 1*a* and 1*b* of FIG. 4 may be fabricated by a roll-to-roll process. The electret layer may be formed with a thickness between about 0.5-100 μm.

Referring to FIG. 4, a film 4 comprises two electret layers 1*a* and 1*b* and a conductive layer 2 placed between the electret layers 1*a* and 1*b*. The electret layers may be made in accordance with the process mentioned above. The conductive layer 2 may be made of gold, silver, aluminum, copper or other conductive materials. The conductive layer 2 may be coated on the electret layer 1*a* by at least one of a spraying coating, spin coating, sputtering, evaporation, screen printing process to form structure 3. In one embodiment, an e-beam evaporator is used to evaporate the metal layer onto the electret layer. The electret layer 1*b* is formed on the structure 3 through a vacuum thermal compression, mechanical compression or roll-to-roll process to form an electret-metal-electret film. A corona charge process may increase charge storage stability of the film 4. In this regard, the film 4 may be applied as a diaphragm used with, for example, an electret speaker. In one embodiment, an electrostatic speaker comprises a film 4 and two electrodes which are electrically coupled with an audio signal input. The electrodes have openings for allowing the sound waves to pass through the openings. The film 4 is sandwiched between the electrodes with an air gap between each of the electrodes and the film 4. The film 4 may be an actuator remotely coupled with and insulated from the electrode to interact with the electrode in response to an audio signal from the audio signal input and to vibrate to generate sound waves.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method of making an electret film, the method comprising providing a polymer-containing solution, the polymer-containing solution comprising at least one polymer material and at least one surfactant;

spreading the polymer-containing solution to provide a wetting polymer film;

curing the wetting polymer film to provide a polymer film; and conducting a Corona charging to the polymer film to form a non-fluoropolymer electret film, wherein the at least one surfactant of the polymer-containing solution comprises at least one of (n+1)-hydroxy-alkanoic acid, (n+1)-amino-alkanoic acid, (n+1)-sulfanyl-alkanoic acid, 2-(n-hydroxy-alkyl)malonic acid, 2-(n-mercapto-alkyl)malonic acid, or 2-(n-amino-alkyl) malonic acid, 2,3-bis-(n-hydroxy-alkyloxy)-succinic acid, 2,3-bis-(n-amino-alkyloxy)-succinic acid, (n+1)-triazol-alkanoic acid, 2,3-bis-(n-triazol-alkyloxy)-succinic acid, sodium dodecyl sulfate (SDS), amphoteric surfactants, nonionic surfactants, cationic surfactants, and anionic surfactants.

2. The method of claim 1, wherein the polymer material and the surfactant have a weight ratio of about 0.01 to $10^5$ ppm.

3. The method of claim 1, wherein a concentration of the surfactant is higher than a critical micelle concentration (CMC) of the polymer-containing solution.

4. The method of claim 1, wherein spreading the polymer-containing solution comprises at least one of spin coating, screen printing, spraying coating, sputtering, evaporating, and scraping the polymer-containing solution.

5. The method of claim 1, further comprising removing at least a portion of the surfactant from the polymer film.

6. The method of claim 1, further comprising coupling the electret film with two electrode plates being placed apart from each other and sandwiching the electret film between the two electrode plates to provide an electret speaker.

7. The method of claim 1, wherein the polymer-containing solution comprises a blended polymer solution containing at least two polymer materials.

8. The method of claim 1, wherein the at least one polymer material of the polymer-containing solution comprises at least one of cyclic olefin copolymer (COC), polystyrene (PS), polycarbonate (PC), polymethylmethacrylate (PMMA), polyvinyl chloride (PVC), polyimide (PI), polyetherimide (PET), high density polyethylene (HDPE), and polypropylene (PP).

9. The method of claim 1, wherein the polymer-containing solution further comprises at least one solvent.

10. The method of claim 9, wherein the solvent comprises at least one of acetone, tetrahydrofuran (THF), toluene, xylene, p-xylene, dichloromethane, chloroform, n-methylpyrrolidone (NMP), and dimethylformamide (DMF).

11. The method of claim 1, wherein the polymer film has a plurality of holes with sizes between about 10 nanometers to 10 micrometer.

12. The method of claim 1, wherein the at least one surfactant of the polymer-containing solution comprises at least one hydrocarbon having the formula $Y—(CH_2)_n—COOH$ in which Y is OH, $NH_2$, or SH, and n ranges from 5 to 10.

13. The method of claim 1, wherein the at least one surfactant of the polymer-containing solution comprises at least one hydrocarbon having the formula $Y—(CH_2)_n—CH(COOH)_2$ in which Y is OH, $NH_2$, or SH, and n ranges from 5 to 10.

14. The method of claim 1, wherein the at least one surfactant of the polymer-containing solution comprises 2-(6-mercaptohexyl)malonic acid.

* * * * *